US007806616B2

(12) United States Patent
Greenberg

(10) Patent No.: US 7,806,616 B2
(45) Date of Patent: Oct. 5, 2010

(54) WRITING INSTRUMENT BARREL INCLUDING A PAINTED INNER SURFACE

(75) Inventor: Yair Greenberg, Woodland Hills, CA (US)

(73) Assignee: Yafa Pen Company, Canoga Park, CA (US)

( * ) Notice: Subject to any disclaimer, the term of this patent is extended or adjusted under 35 U.S.C. 154(b) by 0 days.

(21) Appl. No.: 11/752,211

(22) Filed: May 22, 2007

(65) Prior Publication Data

US 2008/0292384 A1 Nov. 27, 2008

(51) Int. Cl.
*B43K 29/00* (2006.01)

(52) U.S. Cl. ..... 401/195

(58) Field of Classification Search ..... 401/52, 401/195, 292, 192

See application file for complete search history.

(56) References Cited

U.S. PATENT DOCUMENTS

| | | | | |
|---|---|---|---|---|
| 2002/0072562 | A1* | 6/2002 | Asthana | 524/560 |
| 2004/0028460 | A1* | 2/2004 | Sellars | 401/194 |
| 2007/0102110 | A1* | 5/2007 | Yuba et al. | 156/285 |

* cited by examiner

*Primary Examiner*—Huyen Le
(74) *Attorney, Agent, or Firm*—Howard N. Sommers

(57) ABSTRACT

A writing instrument barrel, comprising a body portion, which is generally tubular, and which has a hollow channel extending therethrough. It includes an inner surface, including a paint-adhering material applied to the inner surface for enabling paint to adhere thereto, and paint applied to the paint-adhering material on at least a portion of the inner surface of the body portion to form a painted inner surface. The hollow channel includes opposed ends and openings at the opposed ends thereof. The paint is able to be applied by a brush with paint on the tip thereof, which is able to be extended through the openings in the body portion.

10 Claims, 3 Drawing Sheets

WRITING INSTRUMENT BARREL INCLUDING A PAINTED INNER SURFACE

BACKGROUND OF THE INVENTION

1. Field of the Invention

This invention is generally related to writing instruments, and more particularly, to the barrel of a writing instrument in which the barrel includes a painted inner surface.

2. General Background and State of the Art

A writing instrument may comprise a pen, which includes a nub which contacts the paper, a reservoir which contains the ink, a feed which controls the flow of ink from the reservoir, and a barrel which holds the nub and feed on the writing end and protects the reservoir internally, and which enables gripping thereof and writing therewith.

Alternatively, a writing instrument may comprise a pencil, such as a mechanical pencil, which includes a tip which contacts the paper, an internal lead-pushing mechanism for enabling lead to be inserted therein and for enabling the lead to be pushed through the tip to enable writing therewith, and a barrel which holds the tip on the writing end and protects the internal lead-pushing mechanism, and which enables gripping thereof and writing therewith.

The barrel of a writing instrument, which is able to contain the other elements thereof, is generally tubular. It is also generally transparent, translucent, the color of the plastic or metal material of which it may be comprised, or it may have color or decorations applied to the outside surface thereof.

Therefore, there has been identified a continuing need to provide barrel for a writing instrument which includes paint applied to the inner surface of the barrel.

INVENTION SUMMARY

Briefly, and in general terms, the present invention, in a preferred embodiment, by way of example, is directed to a writing instrument barrel, comprising a body portion, which is generally tubular. The body portion has a hollow channel extending therethrough, and includes an inner surface, including a paint-adhering material applied to the inner surface for enabling paint to adhere thereto. It also includes paint applied to the paint-adhering material on at least a portion of the inner surface of the body portion to form a painted inner surface, wherein the hollow channel in the body portion includes opposed ends and openings at the opposed ends thereof, and wherein the paint is able to be applied by a brush with paint on the tip thereof which is able to be extended through the openings in the body portion.

These and other aspects and advantages of the invention will become apparent from the following detailed description and the accompanying drawings, which illustrate by way of example the features of the invention.

DETAILED DESCRIPTION OF THE PREFERRED EMBODIMENTS

Figure 1:
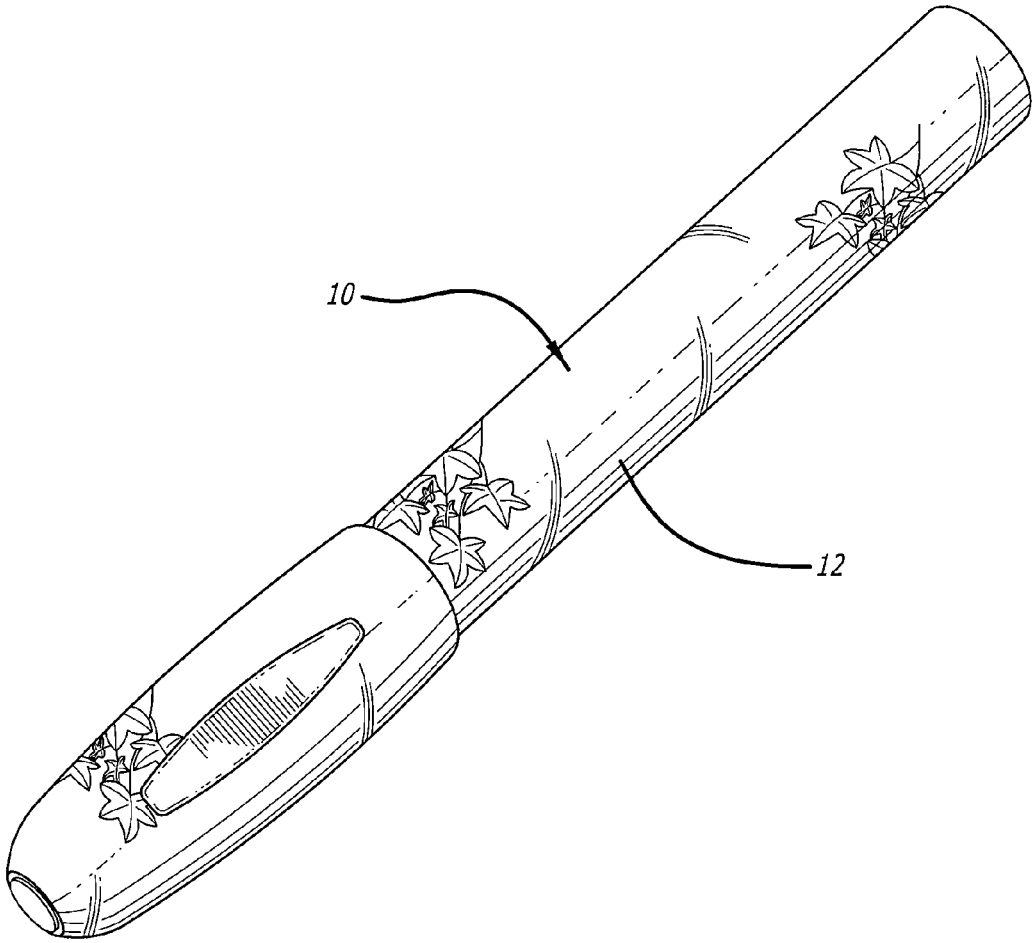
FIG. 1 is a perspective view of a writing instrument barrel which includes a painted inner surface, and a cap for one end thereof.
Figure 5:
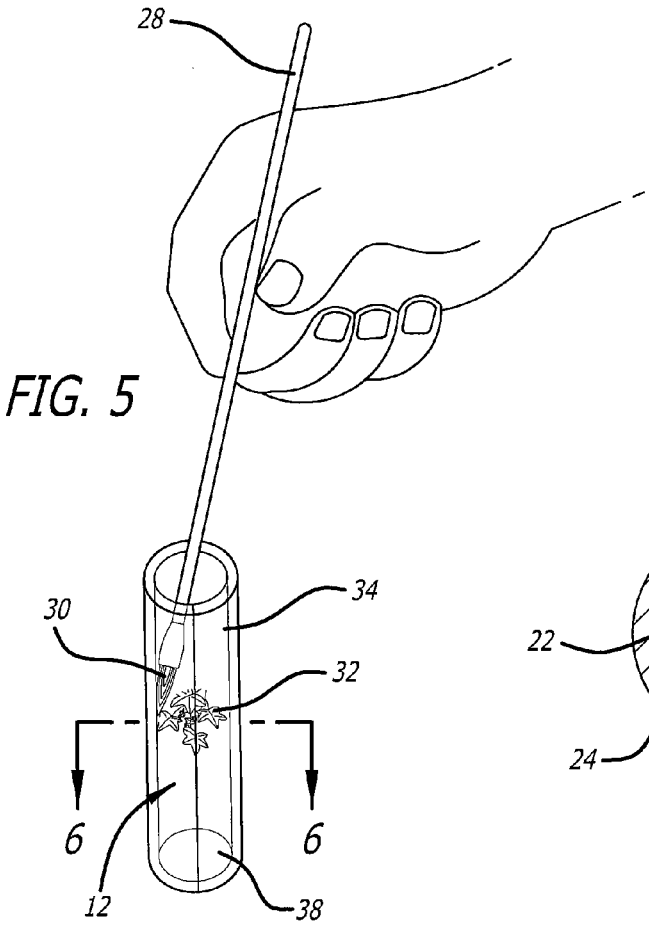
FIG. 5 is a perspective view of paint being applied to the inner surface of a writing instrument barrel.
Figure 6:
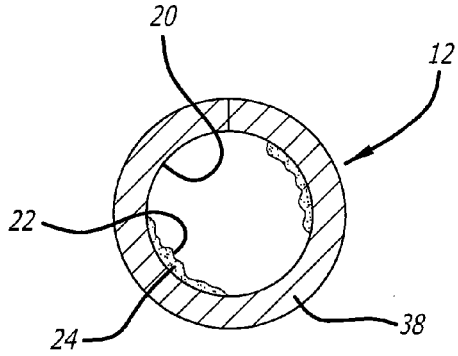
FIG. 6 is a sectional view of a writing instrument barrel with a painted inner surface taken along line 6-6 of FIG. 5.

Referring to the drawings, in which like reference numerals refer to like or corresponding parts, and as illustrated in FIGS. 1, 5 and 6, the writing instrument barrel 10 according to the invention includes a body portion 12, which is generally tubular, which includes opposed ends 14 and has a hollow channel 16 extending therethrough, and which includes an inner surface 18.

There is shown in FIGS. 5 and 6 a writing instrument barrel 10, wherein paint-adhering material 20 is applied to the inner surface 18 for enabling paint to adhere thereto, and paint 22 is applied to the paint-adhering material on at least a portion of the inner surface 18 of the body portion 12 to form a painted inner surface 24. The hollow channel 16 includes openings 26 at the opposed ends 14 of the body portion 12.

As seen in FIGS. 5 and 6, the paint 22 is able to be applied by a brush 28 with paint 22 on the tip 30 thereof. The brush 28 is able to be extended into and through the openings 26 in the body portion 12. The paint 22 is applied to the paint-adhering material 20 to form a painted design 32. The painted design 32 is formed in reverse on the inner surface 18 of the body portion 12. The body portion 12 further includes an outer surface 34, and the formed painted design 32 is in the obverse as viewed from the outer surface 34 of the body portion 12. The outer surface 34 of the body portion 12 is polished. The paint 22 is applied in layers to the paint-adhering material 20. The brush 28 which is able to apply the paint 22 to the paint-adhering material 20 is slender and finely-tipped. The body portion 12 may be comprised of acrylic or a transparent material.

Figure 2:
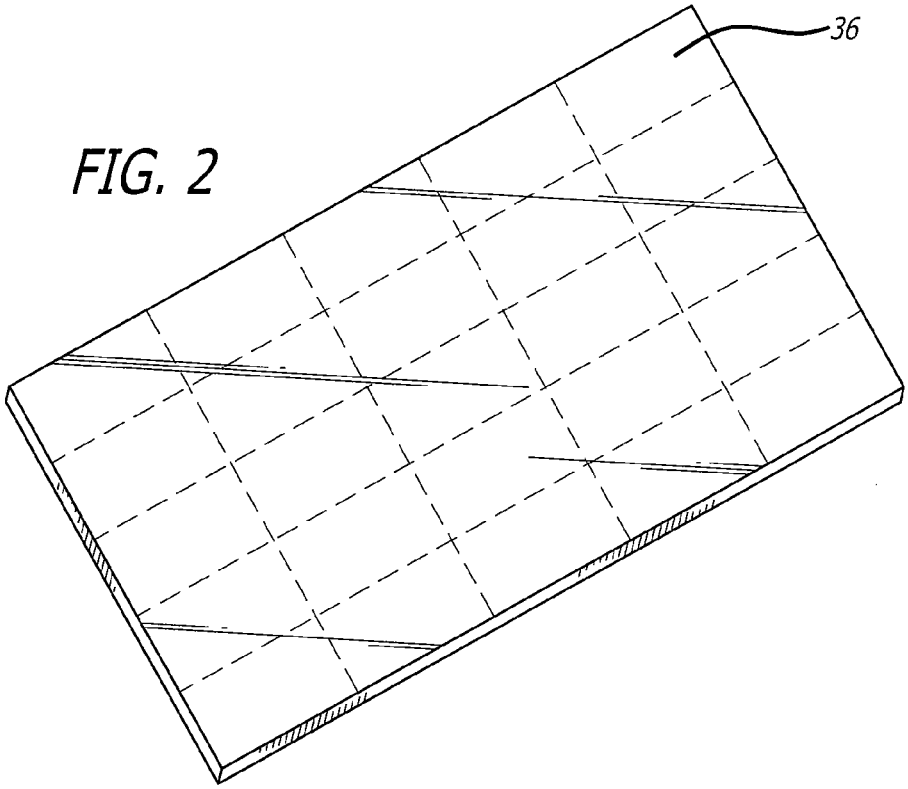
FIG. 2 is a similar view of a sheet of material from which a plurality of writing instrument barrels may be formed.
Figure 3:
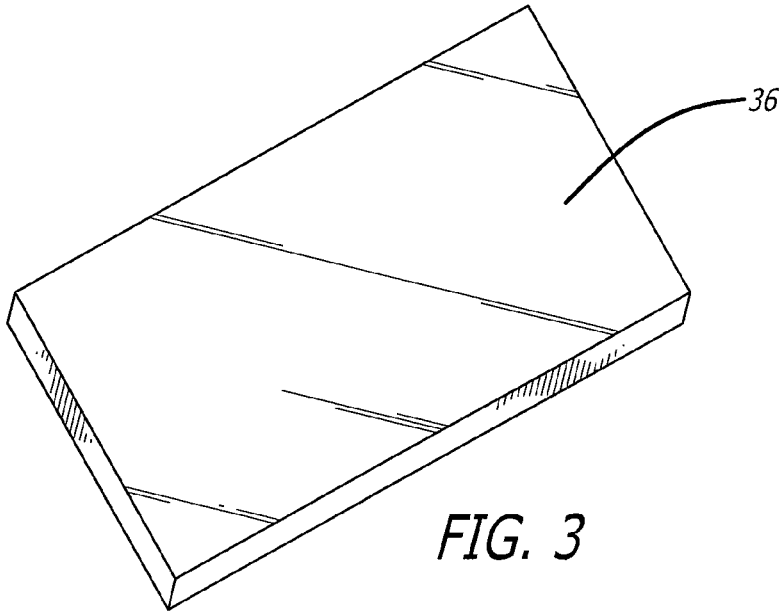
FIG. 3 is a similar view of a sheet of material from which a single writing instrument barrel may be formed.
Figure 4:
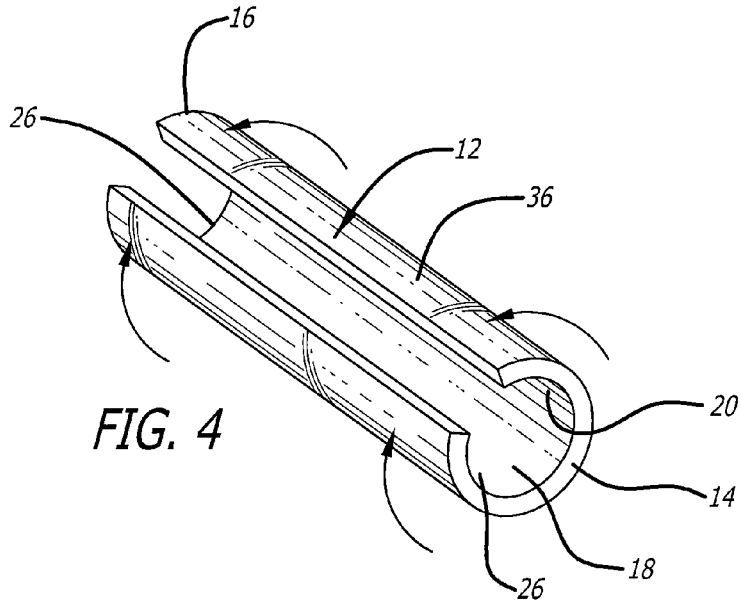
FIG. 4 is a similar view of a sheet of material being formed into a writing instrument barrel.

Referring to FIGS. 2, 3, and 4, the body portion 12 may be formed of a sheet material 36 rolled into the generally tubular configuration 38. The paint-adhering material 20 is rubbed into the sheet of material 34. The body portion 12 may be formed of a solid rod with the channel 16 formed therethrough. The writing instrument barrel 12 may further include an ink reservoir, a feed, and a nub, connected at one of the opposed ends 14 of the body portion 12, through which ink may be dispensed, which would comprise a pen. The writing instrument barrel may alternatively include an internal lead-pushing mechanism and a tip, connected at one of the opposed ends 14 of the body portion 12, through which a lead may extend, which would comprise a pencil.

While the particular writing instrument barrel as shown and disclosed in detail herein is fully capable of obtaining the objects and providing the advantages previously stated, it is to be understood that it is merely illustrative of the presently preferred embodiment of the invention, and that no limitations are intended to the details of construction or design shown herein other than as described in the appended claims.

I claim:

1. A method of forming a writing instrument barrel, wherein the writing instrument barrel comprises a body portion, which is generally tubular, which has a hollow channel extending therethrough which includes opposed ends and openings at the opposed ends thereof and which body portion includes an inner surface, including a paint-adhering material applied to the inner surface for enabling paint to adhere thereto, and paint applied to the paint-adhering material on at least a portion of the inner surface of the body portion after the body portion is formed, by extending a brush with paint on the tip thereof through at least one of the openings in the body portion to form a painted inner surface of the body portion after the body portion is formed, wherein the method comprises:

forming the body portion; and extending a brush with paint on the tip thereof through at least one of the openings formed in the body portion to form a painted inner surface of the body portion after the body portion is formed.

2. A method as in claim 1, wherein the paint is applied to the paint-adhering material to form a painted design, and wherein applying in the method further comprises applying the paint to the paint-adhering material for form a painted design.

3. A method as in claim 1, wherein the paint is applied in layers to the paint-adhering material, and wherein applying in the method further comprises applying the paint in layers to the paint-adhering material.

4. A method as in claim 1, wherein the brush which is able to apply the paint to the paint-adhering material is slender and finely-tipped, and wherein applying in the method further comprises applying paint by the slender finely-tipped brush.

5. A method as in claim 1, wherein the body portion is comprised of acrylic, and wherein forming in the method further comprises forming the body portion of acrylic.

6. A method as in claim 1, wherein the body portion is comprised of a transparent material, and wherein forming in the method further comprises forming the body portion of a transparent material.

7. A method as in claim 1, wherein the body portion is formed of a sheet material rolled into the generally tubular configuration of the body portion, and wherein forming in the method comprises rolling the sheet material into the generally tubular configuration of the body portion.

8. A method as in claim 1, wherein the body portion is formed of a solid rod with the channel formed therethrough, and wherein forming in the method further comprises forming the body portion by forming the channel through the solid rod.

9. A method as in claim 1, further including an ink reservoir, a feed, and a nub, connected to one of the opposed ends of the body portion, through which ink may be dispensed, and wherein the method further comprises connecting the ink reservoir, feed, and nib to one of the opposed ends of the body portion through which ink may be dispensed.

10. A method as in claim 1, further including an internal lead-pushing mechanism, and a tip, connected to one of the opposed ends of the body portion, through which a lead may extend, and wherein the method further comprises connecting the internal lead-pushing mechanism and the tip to one of the opposed ends of the body portion through which the lead may extend.

* * * * *